US011859392B2

(12) United States Patent
Casale

(10) Patent No.: US 11,859,392 B2
(45) Date of Patent: Jan. 2, 2024

(54) DECK BOARD COVER ASSEMBLY

(71) Applicant: James Casale, Seaside Heights, NJ (US)

(72) Inventor: James Casale, Seaside Heights, NJ (US)

( * ) Notice: Subject to any disclaimer, the term of this patent is extended or adjusted under 35 U.S.C. 154(b) by 0 days.

(21) Appl. No.: 17/666,054

(22) Filed: Feb. 7, 2022

(65) Prior Publication Data

US 2023/0250646 A1 Aug. 10, 2023

(51) Int. Cl.
*E04F 15/02* (2006.01)

(52) U.S. Cl.
CPC .. *E04F 15/02183* (2013.01); *E04F 15/02155* (2013.01); *E04F 15/02172* (2013.01); *E04F 2290/04* (2013.01)

(58) Field of Classification Search
CPC ..... E04F 15/02183; E04F 15/02155; E04F 15/02172; E04F 15/02161; E04F 2290/04
See application file for complete search history.

(56) References Cited

U.S. PATENT DOCUMENTS 4,885,882 A * 12/1989 Forshee ..... B63B 3/48 52/177
4,907,387 A * 3/1990 Turnbull ..... E04F 15/02183 52/177
5,351,458 A * 10/1994 Lehe ..... A01K 1/015 52/177
5,613,339 A * 3/1997 Pollock ..... E04B 5/12 52/177
5,735,097 A * 4/1998 Cheyne ..... E04B 5/026 52/489.1
6,108,992 A * 8/2000 Shaw ..... E04B 5/12 52/177
6,966,963 B2 11/2005 O'Connor
7,441,378 B2 10/2008 Wood
7,673,425 B2 * 3/2010 Thomas ..... E04D 13/0445 52/177
8,251,018 B2 * 8/2012 Mooney ..... A01K 1/0151 119/527
8,945,332 B2 2/2015 Bogan
9,534,377 B2 * 1/2017 Lee ..... E04B 1/003
10,125,500 B2 11/2018 Sisler
10,138,638 B1 11/2018 Deady
(Continued)

FOREIGN PATENT DOCUMENTS

AU 726444 B2 * 11/2000
CA 2783319 A1 * 2/2013 ..... E04F 15/02183
WO WO2018130720 7/2018

*Primary Examiner* — Theodore V Adamos

(57) ABSTRACT

A deck board cover assembly includes a plurality of deck board covers. Each of the deck board covers is positionable over a respective one of a plurality of deck boards of a deck. Each of the deck board covers is comprised of a fluid impermeable material to protect the deck boards from precipitation. Each of the deck board covers has a plurality of gripping elements each is integrated into the deck board covers for retaining the deck board covers on the respective deck boards. A plurality of adhesive strips is each bonded to a respective one of the deck board covers. Each of the adhesive strips adhesively engages the respective deck board upon which the deck board covers are positioned for retaining the deck board covers on the respective deck board.

5 Claims, 6 Drawing Sheets

(56) References Cited

U.S. PATENT DOCUMENTS

| | | | | |
|---|---|---|---|---|
| D862,270 | S | 10/2019 | Povoli | |
| 11,060,304 | B1 * | 7/2021 | Spanovich | E04B 1/003 |
| 2002/0023395 | A1 * | 2/2002 | Pasterchick | E04F 15/02183 52/177 |
| 2003/0140581 | A1 * | 7/2003 | Ludington | E04F 15/10 52/177 |
| 2005/0178071 | A1 * | 8/2005 | Wood | E04F 15/02 52/836 |
| 2010/0132276 | A1 | 6/2010 | Landry | |
| 2013/0291457 | A1 * | 11/2013 | Tillery | E04F 15/107 52/177 |
| 2014/0363621 | A1 * | 12/2014 | Ngo | B27B 9/02 52/309.1 |
| 2021/0131115 | A1 | 5/2021 | Fogel | |

* cited by examiner

DECK BOARD COVER ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to cover devices and more particularly pertains to a new cover device for protecting deck boards from precipitation. The device includes a plurality of covers that is each positionable over a respective deck board of a deck. Each of the covers includes gripping elements that grips the respective deck board for retaining the covers on the deck board and an adhesive layer that adheres to the deck board. Additionally, each of the deck boards has a pebbled texture to enhance traction for walking on the covers.

(2) Description of Related Art Including Information Disclosed Under 37 CFR 1.97 and 1.98

The prior art relates to cover devices including a deck covering device that includes a plurality of elongate strips being comprised of a fibrous layer and a moldable layer. The prior art discloses a deck plank cover which each has a top wall and a pair of lateral walls that are biased to engage a deck plank. The prior art discloses a flooring finish system that includes a plurality of synthetic wood strips and a glue that is applied to the synthetic wood strips for securing the synthetic wood strips to a floor. The prior art discloses a deck covering device that includes a panel that has a textured top surface to resemble wood grain and an adhesive layer which adhesively engages a deck plank. The prior art discloses a deck covering that comprises a central portion and a pair of side portions that are pivotable on the central portion for engaging a deck plank.

BRIEF SUMMARY OF THE INVENTION

An embodiment of the disclosure meets the needs presented above by generally comprising a plurality of deck board covers. Each of the deck board covers is positionable over a respective one of a plurality of deck boards of a deck. Each of the deck board covers is comprised of a fluid impermeable material to protect the deck boards from precipitation. Each of the deck board covers has a plurality of gripping elements each is integrated into the deck board covers for retaining the deck board covers on the respective deck boards. A plurality of adhesive strips is each bonded to a respective one of the deck board covers. Each of the adhesive strips adhesively engages the respective deck board upon which the deck board covers are positioned for retaining the deck board covers on the respective deck board.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
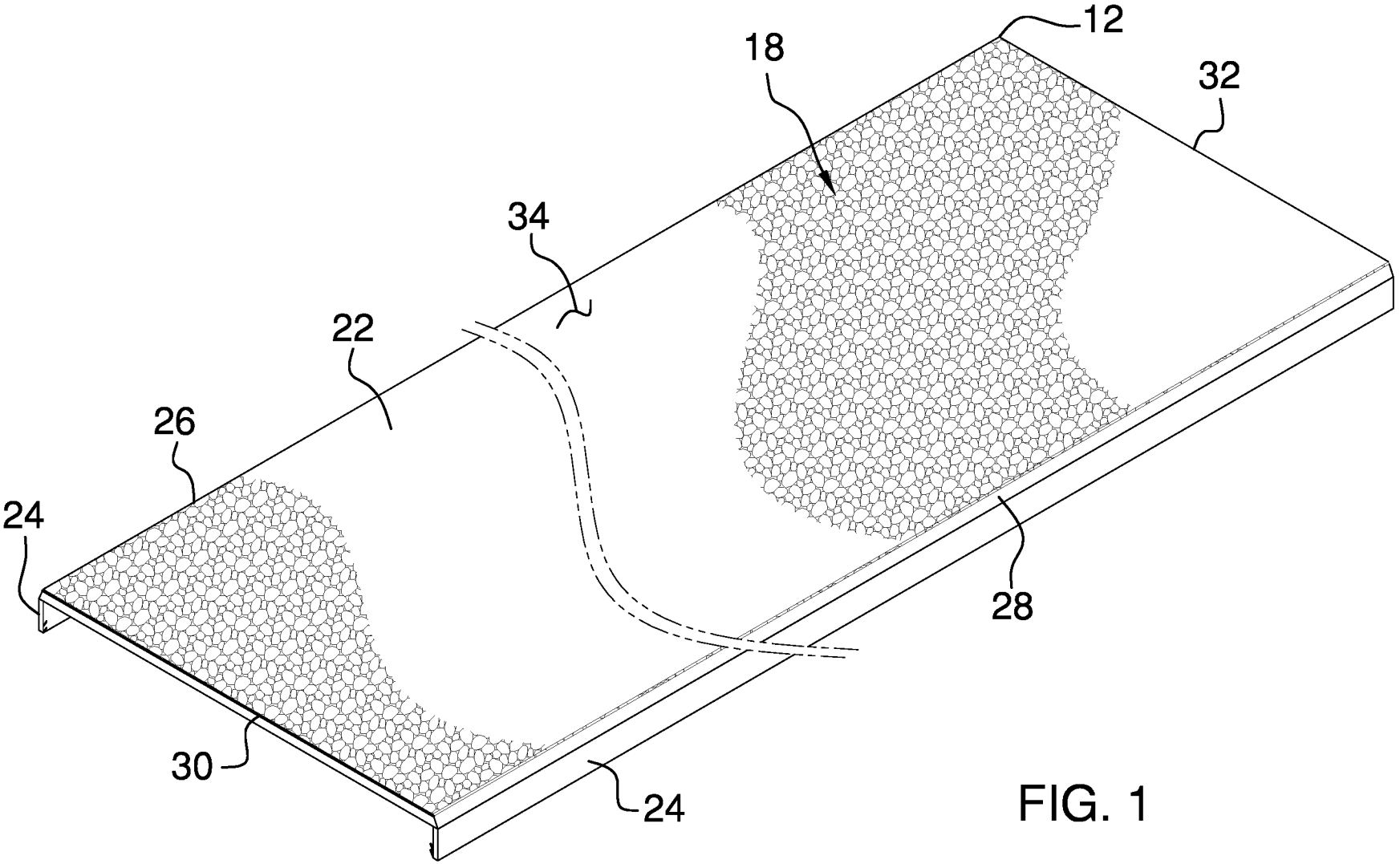
FIG. 1 is a top perspective view of a deck board cover assembly according to an embodiment of the disclosure.
Figure 2:
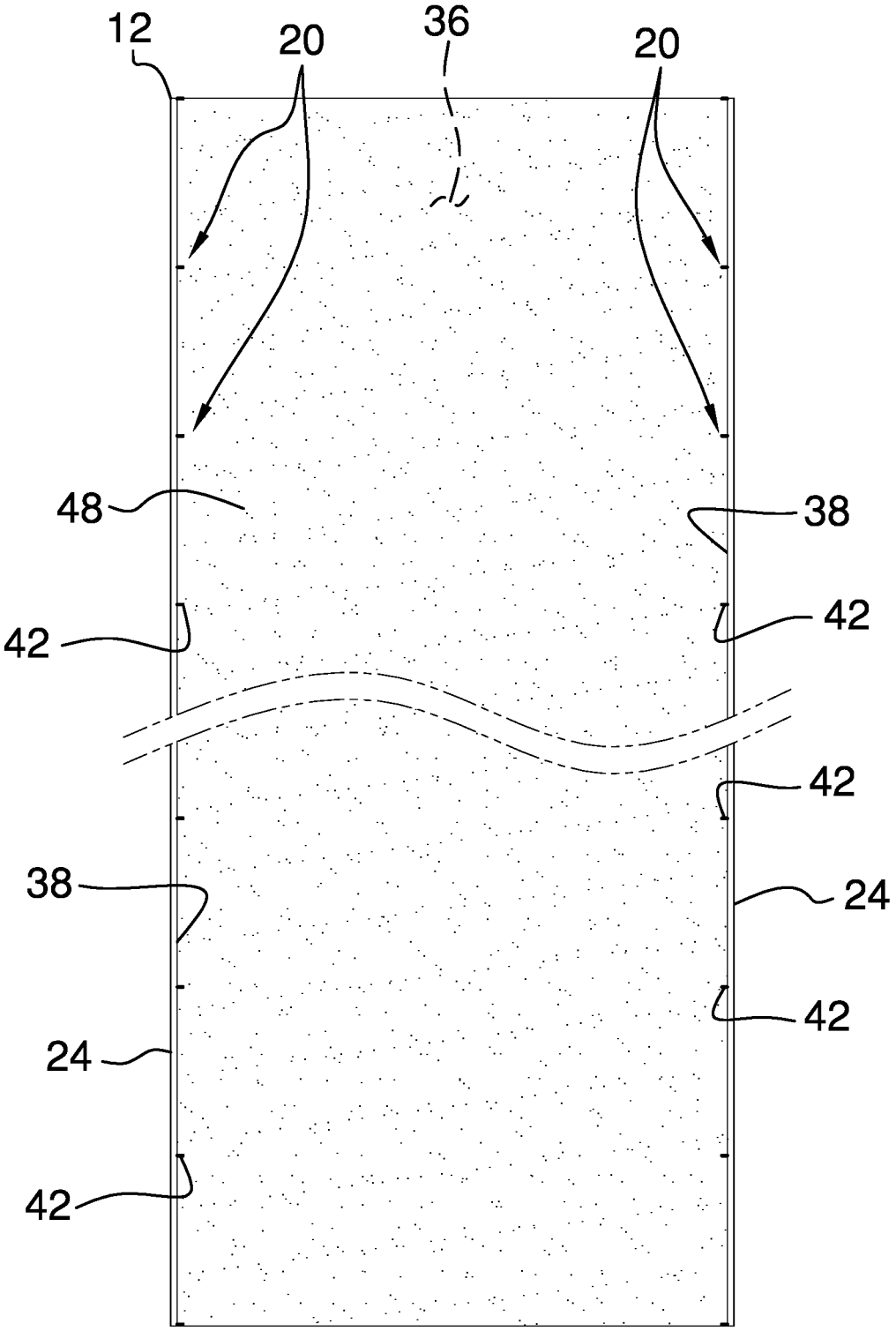
FIG. 2 is a bottom view of an embodiment of the disclosure.
Figure 3:
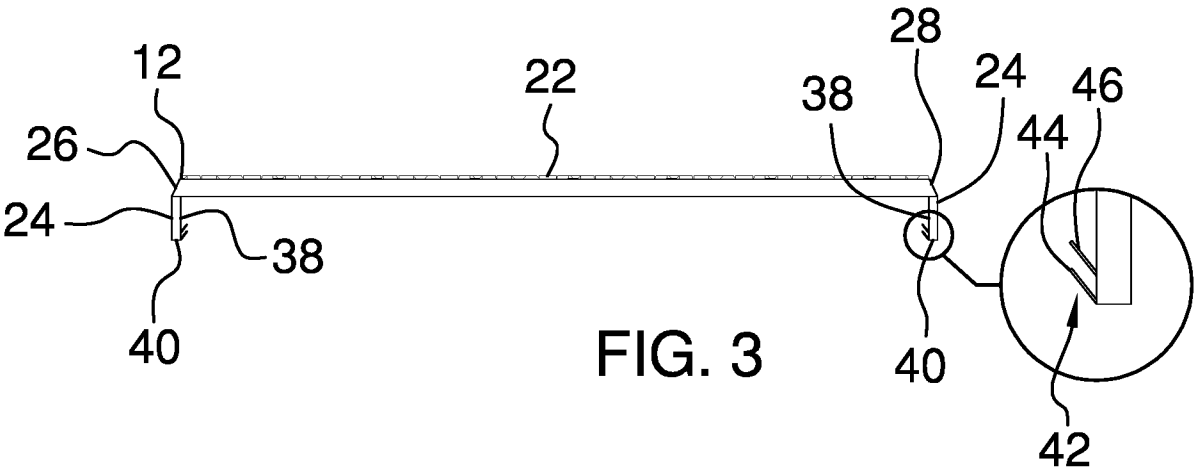
FIG. 3 is a front view of an embodiment of the disclosure.
Figure 4:
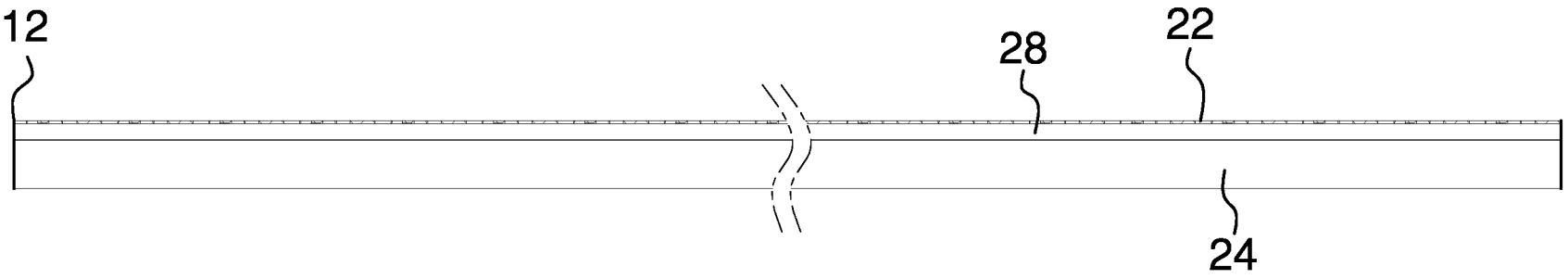
FIG. 4 is a right side view of an embodiment of the disclosure.
Figure 5:
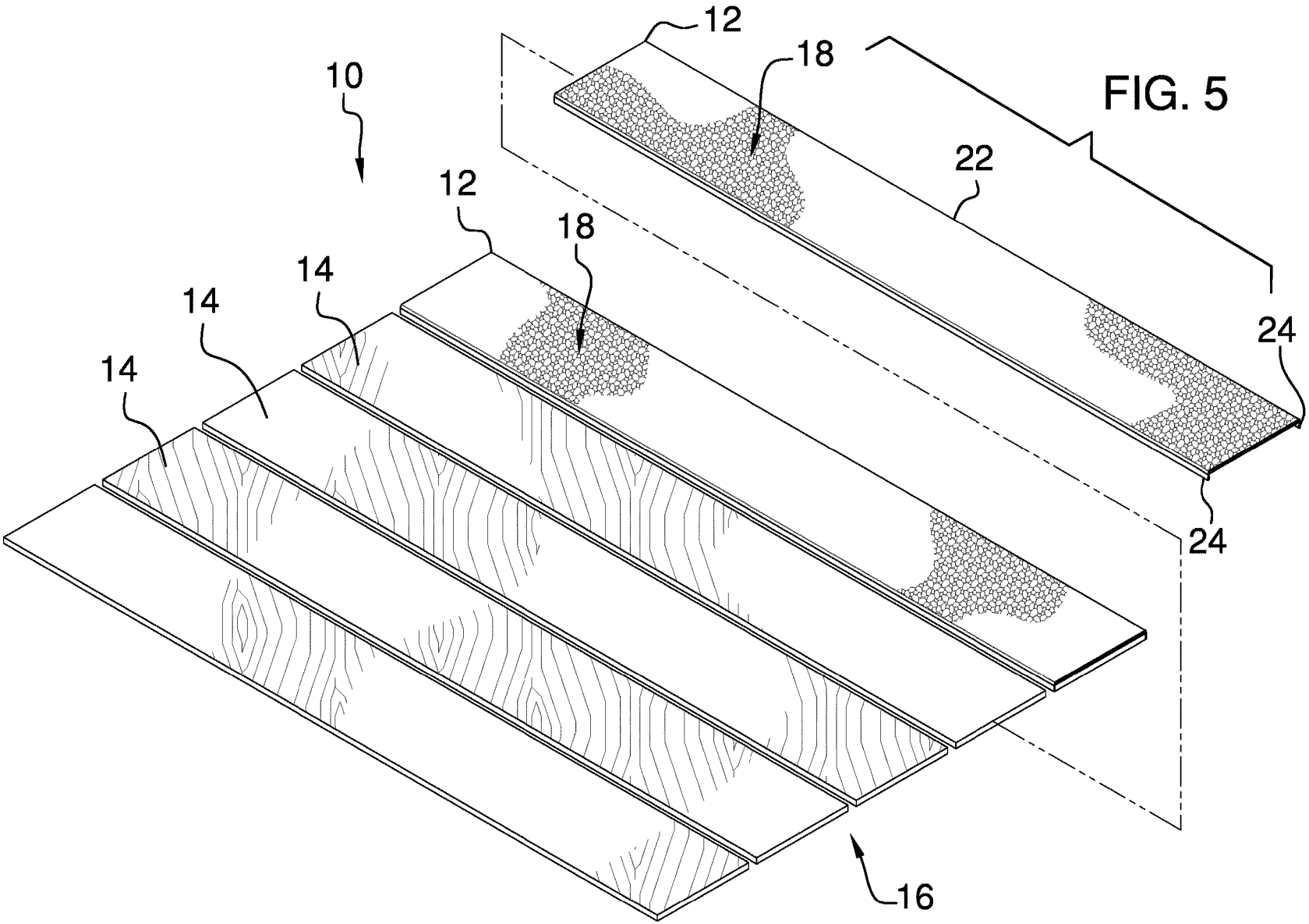
FIG. 5 is a perspective in-use view of an embodiment of the disclosure.

With reference now to the drawings, and in particular to FIGS. 1 through 8 thereof, a new cover device embodying the principles and concepts of an embodiment of the disclosure and generally designated by the reference numeral 10 will be described.

As best illustrated in FIGS. 1 through 8, the deck board cover assembly 10 generally comprises a plurality of deck board covers 12 that is each positionable over a respective one of a plurality of deck boards 14 of a deck 16. The deck 16 may be an outdoor deck that is attached to a house, an apartment or other type of occupancy. Each of the deck board covers 12 is comprised of a fluid impermeable material, including but not being limited to, polyvinylchloride or acrylonitrile butadiene styrene, to protect the deck boards 14 from precipitation. Additionally, each of the deck board covers 12 has a pebbled texture 18 integrated into the deck board covers 12 for enhancing traction on the deck board covers 12. In this way, the plurality of deck board covers 12 can enhance traction for a user.

Each of the deck board covers 12 has a plurality of gripping elements 20 each being integrated into the deck board covers 12. Each of the gripping elements 20 engages the respective deck 16 board upon which each of the deck board covers 12 is placed for retaining the deck board covers 12 on the respective deck boards 14. Each of the deck board covers 12 has a top wall 22 and a pair of lateral walls 24 each extending downwardly from a respective first lateral edge 26 and a second lateral edge 28 of the top wall 22. Additionally, the top wall 22 has a front edge 30 and a back edge 32, and the top wall 22 is elongated between the front edge 30 and the back edge 32. Each of the lateral walls 24 extends between the front edge 30 and the back edge 32.

The top wall 22 has a top surface 34 and a bottom surface 36, and the pebbled texture 18 is integrated into the top surface 34 such that the pebbled texture 18 is exposed when the deck board covers 12 are positioned on the deck boards 14. Each of the first lateral edge 26 and the second lateral edge 28 slope toward a center of the deck board covers 12 between the lateral walls 24 and the top wall 22. In this way the plurality of deck board covers 12 facilitate moisture to run downwardly between the deck board covers 12 when the deck board covers 12 are positioned on the deck boards 14.

Each of the lateral walls 24 has a first surface 38 that is directed toward each other and a distal edge 40 with respect to the top wall 22. The plurality of gripping elements 20 comprises a plurality of sets of barbs 42 and each of the sets of barbs 42 extends away from the first surface 38 of a respective one of the lateral walls 24. Each of the sets of barbs 42 is positioned adjacent to the distal edge 40 of the respective lateral wall 24. Additionally, each of the sets of barbs 42 is angled upwardly toward the top wall 22 such that each of the sets of barbs 42 inhibits the deck board covers 12 from being lifted upwardly from the respective deck 16 board. The plurality of sets of barbs 42 is spaced apart from each other and is distributed along a full length of the respective lateral wall 24. Each of the sets of barbs 42 including a lower barb 44 that is aligned with the distal edge 40 of the respective lateral wall 42 and an upper barb 46 that is positioned above the lower barb 44.

A plurality of adhesive strips 48 is provided and each of the adhesive strips 48 is bonded to a respective one of the deck board covers 12. Each of the adhesive strips 48 adhesively engages the respective deck 16 board upon which the deck board covers 12 are positioned for retaining the deck board covers 12 on the respective deck 16 board. Each of the adhesive strips 48 is positioned on the bottom surface 36 of the top wall 22 of the respective deck 16 board cover and each of the adhesive strips 48 completely covers 12 the bottom surface 36. The front edge 30 of each of the top wall 22 deck board covers 12 may have a recess extending into the front edge 30. Additionally, the back edge 32 of the top wall 22 of each of the deck board covers 12 may have a tab that can engage the recess in an adjacent one of the deck board covers 12.

Figure 6:
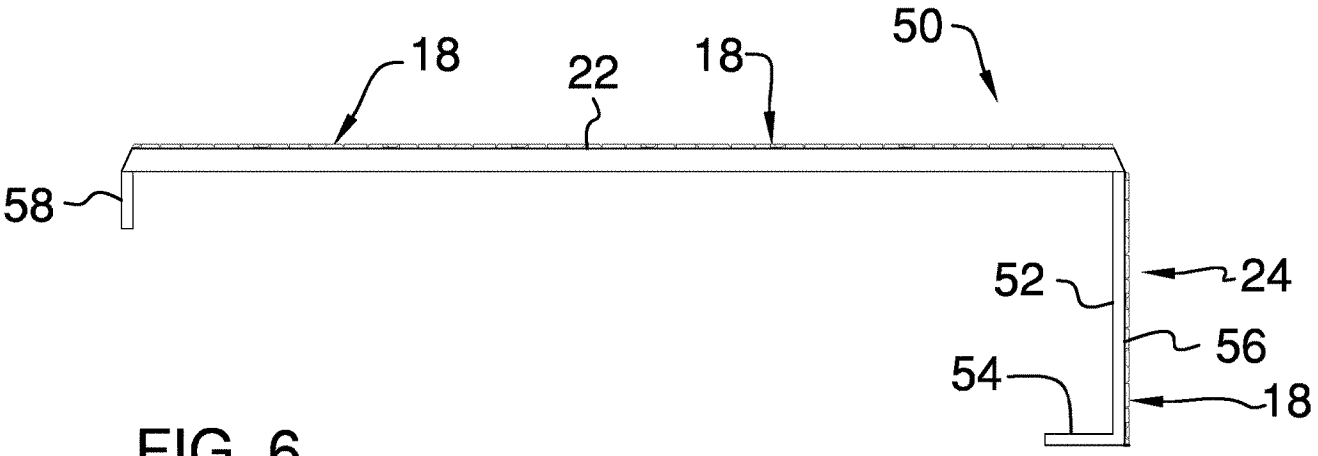
FIG. 6 is a front view of an alternative embodiment of the disclosure.

In an alternative embodiment 50 as is most clearly shown in FIG. 6, a respective one of the lateral walls 24 comprises a leg 52 extending downwardly from the top wall 22 and a foot 54 extending toward a center of the top wall 22. The leg 52 extends downwardly along a riser of a step upon which the top wall 22 is positioned and having the foot 54 extending beneath the riser to secure the deck 16 board cover on the step. The leg 52 has an outwardly facing surface 56 and the pebbled texture 18 is integrated into the outwardly facing surface 56. Additionally, the pair of lateral walls 24 includes a short lateral wall 58 which has a length that is substantially shorter than the leg 52 associated with the respective lateral wall 24.

Figure 7:
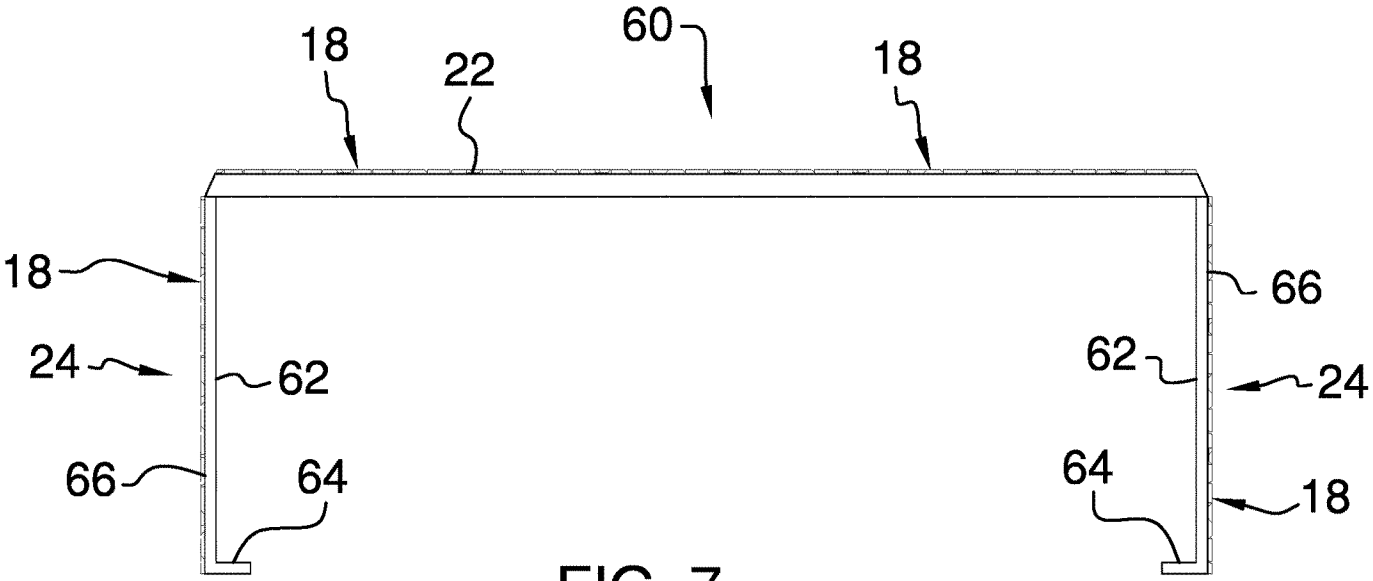
FIG. 7 is a back view of an alternative embodiment of the disclosure.

In an alternative embodiment 60 as is most clearly shown in FIG. 7, each of the lateral walls 24 comprises a leg 62 extending downwardly from the top wall 22 and a foot 64 that is directed toward a center of the top wall 22. The leg 62 of each of the lateral walls 24 extends downwardly along opposite sides of a railing when the top wall 22 rests on top of the railing and the foot 64 of each of the lateral walls 24 extends beneath the railing. The leg 62 of each of the lateral walls 24 has outwardly facing surface 66 and the pebbled texture 18 is integrated into the outwardly facing surface 66.

Figure 8:
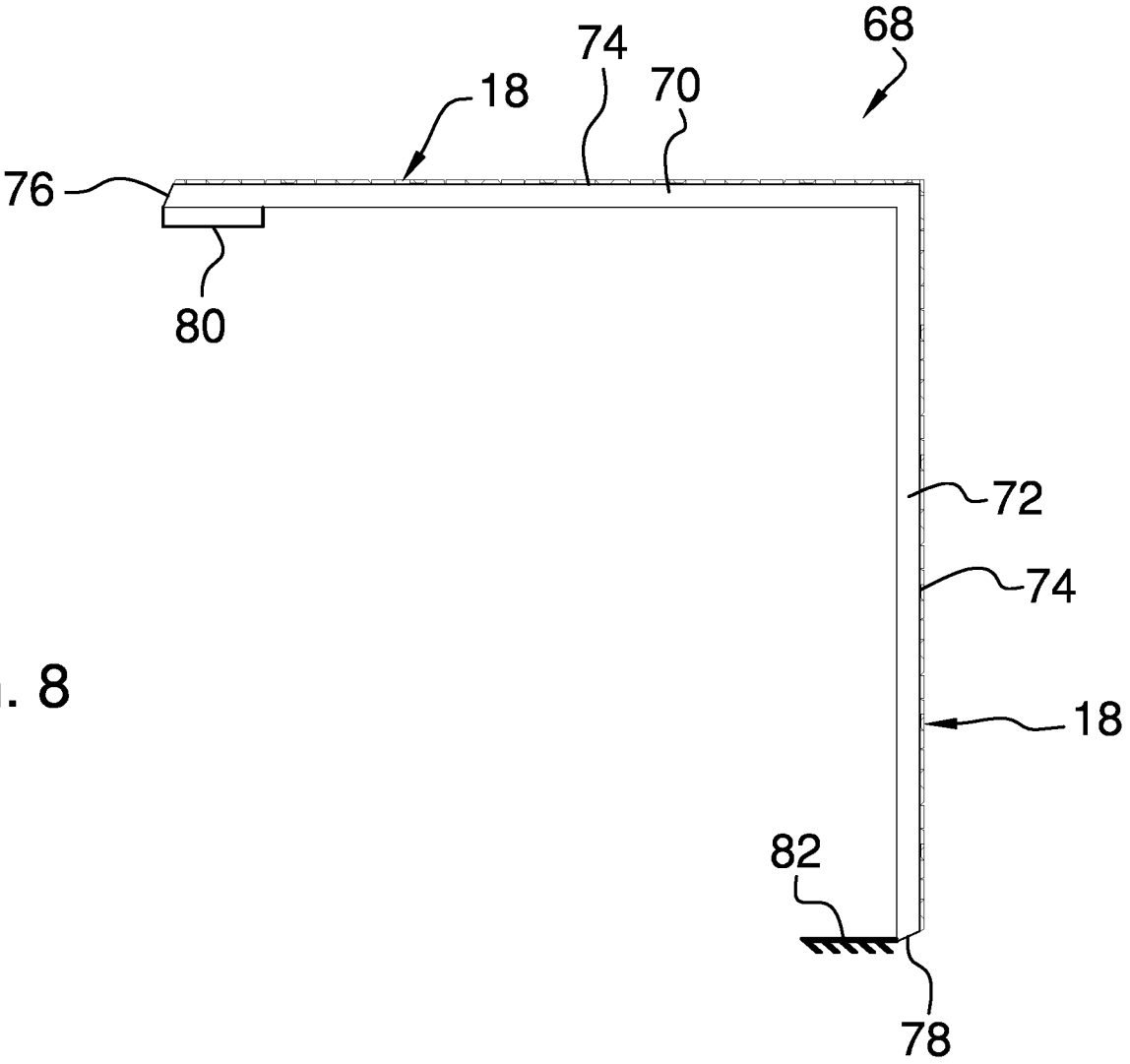
FIG. 8 is a perspective view of an alternative embodiment of the disclosure.

In an alternative embodiment 68 as is most clearly shown in FIG. 8, each of the deck board covers 12 comprises a first wall 70 that is perpendicularly oriented with a second wall 72. Each of the first wall 70 and the second wall 72 has an outwardly facing surface 74 and the pebbled texture 18 is integrated into the outwardly facing surface 74. The first wall 70 has a distal edge 76 with respect to the second wall 72 and the second wall 72 has a distal edge 78 with respect to the first wall 70.

Continuing in the alternative embodiment 68 in FIG. 8, the first wall 70 has a receiver 80 that is integrated into the first wall 70 and the receiver 80 is positioned adjacent to the distal edge 78 of the first wall 70. The second wall 72 has an engagement 82 extending away from the second wall 72 and the engagement 82 is positioned adjacent to the distal edge 78 of the second wall 72. The receiver 80 in a respective one of the deck board covers 12 insertably receives the engagement 82 for attaching a pair of the deck board covers 12 around a post.

In use, the plurality of deck board covers 12 is each positioned on the respective deck 16 board to protect the respective deck 16 board from precipitation. Additionally, the deck board covers 12 eliminate the need to paint or stain the deck boards 14 for the purposes of maintenance. In this way the deck board covers 12 extend the service life of the deck boards 14 without requiring regular maintenance to be performed on the deck boards 14. Each of the deck board covers 12 described in the alternative embodiment 50 shown in FIG. 6 can be positioned on steps of the deck 16 and each of the deck board covers 12 described in the alternative embodiment 60 shown in FIG. 7 can be positioned on a railing of the deck 16. Each of the deck board covers 12 described in the alternative embodiment 68 shown in FIG. 8 can be positioned around railing posts of the deck 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

The invention claimed is:

1. A deck board cover assembly for covering existing deck boards to enhance the appearance of the existing deck boards, said assembly comprising:

a plurality of deck board covers, each of said deck board covers being positionable over a respective one of a plurality of deck boards of a deck, each of said deck board covers being comprised of a fluid impermeable material wherein said plurality of deck board covers is configured to protect the deck boards from precipitation, each of said deck board covers having a pebbled texture being integrated into said deck board covers for enhancing traction on the deck board covers wherein said plurality of deck board covers is configured to enhance traction for a user, each of said deck board covers having a plurality of gripping elements each being integrated into said deck board covers, each of said gripping elements engaging the respective deck board upon which each of said deck board covers is placed for retaining said deck board covers on the respective deck boards;

a plurality of adhesive strips, each of said adhesive strips being bonded to a respective one of said deck board covers, each of said adhesive strips adhesively engaging the respective deck board upon which said deck board covers are positioned for retaining said deck board covers on the respective deck board;

wherein each of said deck board covers has a top wall and a pair of lateral walls each extends downwardly from a respective first lateral edge and a second lateral edge of said top wall, said top wall having a front edge and a back edge, said top wall being elongated between said front edge and said back edge, each of said lateral walls extending between said front edge and said back edge, said top wall having a top surface and a bottom surface, said top surface having said pebbled texture being integrated therein such that said pebbled texture is exposed when said deck board covers are positioned on the deck boards, each of said lateral walls having a first surface being directed toward each other and a distal edge with respect to said top wall;

wherein each of said first lateral edge and said second lateral edge slopes toward a center of said deck board covers between said lateral walls and said top wall wherein said plurality of deck board covers are configured to facilitate moisture to run downwardly between said deck board covers when said deck board covers are positioned on the deck boards; and wherein said plurality of gipping elements comprises a plurality of sets of barbs, each of said sets of barbs extending away from said first surface of a respective one of said lateral walls, each of said sets of barbs being positioned adjacent to said distal edge of said respective lateral wall, said plurality of sets of barbs being spaced apart from each other and being distributed along a full length of said respective lateral wall, each of said barbs extending from said first surface outwardly and towards the top wall wherein each barb forms an acute angle with the respective lateral wall such that the acute angle faces the top wall.

2. The assembly according to claim 1, wherein each of said sets of barbs is angled upwardly toward said top wall such that each of said sets of barbs inhibits said deck board covers from being lifted upwardly from the respective deck board.

3. The assembly according to claim 1, wherein each of said sets of barbs includes a lower barb being aligned with said distal edge of said respective lateral wall and a upper barb being positioned above said lower barb.

4. The assembly according to claim 1, wherein each of said adhesive strips is positioned on said bottom surface of said top wall of said respective deck board cover, each of said adhesive strips completely covering said bottom surface.

5. A deck board cover assembly for covering existing deck boards to enhance the appearance of the existing deck boards, said assembly comprising:

a plurality of deck board covers, each of said deck board covers being positionable over a respective one of a plurality of deck boards of a deck, each of said deck board covers being comprised of a fluid impermeable material wherein said plurality of deck board covers is configured to protect the deck boards from precipitation, each of said deck board covers having a pebbled texture being integrated into said deck board covers for enhancing traction on the deck board covers wherein said plurality of deck board covers is configured to enhance traction for a user, each of said deck board covers having a plurality of gripping elements each being integrated into said deck board covers, each of said gripping elements engaging the respective deck board upon which each of said deck board covers is placed for retaining said deck board covers on the respective deck boards, each of said deck board covers having a top wall and a pair of lateral walls each extending downwardly from a respective first lateral edge and a second lateral edge of said top wall, said top wall having a front edge and a back edge, said top wall being elongated between said front edge and said back edge, each of said lateral walls extending between said front edge and said back edge, said top wall having a top surface and a bottom surface, said top surface having said pebbled texture being integrated therein such that said pebbled texture is exposed when said deck board covers are positioned on the deck boards, each of said first lateral edge and said second lateral edge sloping toward a center of said deck board covers between said lateral walls and said top wall wherein said plurality of deck board covers are configured to facilitate moisture to run downwardly between said deck board covers when said deck board covers are positioned on the deck boards, each of said lateral walls having a first surface being directed toward each other and a distal edge with respect to said top wall, said plurality of gripping elements comprising a plurality of sets of barbs, each of said sets of barbs extending away from said first surface of a respective one of said lateral walls, each of said sets of barbs being positioned adjacent to said distal edge of said respective lateral wall, each of said sets of barbs being angled upwardly toward said top wall such that each of said sets of barbs inhibits said deck board covers from being lifted upwardly from the respective deck board, said plurality of sets of barbs being spaced apart from each other and being distributed along a full length of said respective lateral wall, each of said sets of barbs including a lower barb being aligned with said distal edge of said respective lateral wall and a upper barb being positioned above said lower barb, each of said barbs extending from said first surface outwardly and towards the top wall wherein each barb forms an acute angle with the respective lateral wall such that the acute angle faces the top wall; and a plurality of adhesive strips, each of said adhesive strips being bonded to a respective one of said deck board covers, each of said adhesive strips adhesively engaging the respective deck board upon which said deck board covers are positioned for retaining said deck board covers on the respective deck board, each of said adhesive strips being positioned on said bottom surface of said top wall of said respective deck board cover, each of said adhesive strips completely covering said bottom surface.

* * * * *